US006584901B1

(12) United States Patent
Sarda

(10) Patent No.: US 6,584,901 B1
(45) Date of Patent: Jul. 1, 2003

(54) INKING DEVICE FOR A PRINTING PRESS

(76) Inventor: Jean-Claude Sarda, 92 avenue Secrétan, Paris (FR), F-75019

( * ) Notice: Subject to any disclaimer, the term of this patent is extended or adjusted under 35 U.S.C. 154(b) by 0 days.

(21) Appl. No.: 09/700,234

(22) PCT Filed: May 10, 1999

(86) PCT No.: PCT/EP99/03580

§ 371 (c)(1),
(2), (4) Date: Jan. 12, 2001

(87) PCT Pub. No.: WO99/58339

PCT Pub. Date: Nov. 18, 1999

(30) Foreign Application Priority Data

May 11, 1998 (FR) ..... 98 05872
Apr. 2, 1999 (FR) ..... 99 04126

(51) Int. Cl.[7] ..... B41F 31/05
(52) U.S. Cl. ..... 101/350.1; 101/365
(58) Field of Search ..... 101/155, 154, 101/167, 348, 349.1, 350.1, 367, 365

(56) References Cited

U.S. PATENT DOCUMENTS

| | | | | | |
|---|---|---|---|---|---|
| 2,498,213 | A | * | 2/1950 | Ljungquist | 101/169 |
| 4,773,327 | A | | 9/1988 | Moetteli | 101/365 |
| 5,437,227 | A | * | 8/1995 | Straubinger | 101/156 |
| 5,694,850 | A | * | 12/1997 | Pickard | 101/157 |
| 5,778,785 | A | * | 7/1998 | Blackwell | 101/365 |

FOREIGN PATENT DOCUMENTS

| | | | | | |
|---|---|---|---|---|---|
| DE | 3707570 | A1 | * | 9/1988 | B41F/31/04 |
| DE | 4323047 | A | | 3/1995 | |
| EP | 42934 | A | | 1/1982 | |
| EP | 635363 | A | | 1/1995 | |
| GB | 2156276 | A | * | 10/1985 | B41F/31/04 |
| JP | 58173662 | A | | 10/1983 | |
| WO | WO 9419194 | A1 | * | 9/1994 | B41F/31/04 |

* cited by examiner

*Primary Examiner*—Daniel J. Colilla
(74) *Attorney, Agent, or Firm*—Darby & Darby

(57) ABSTRACT

The invention described here concerns the operation and mode of cleaning of ink fountains of printing presses, sheet-fed, continuous, offset, letterpress or similar, and relates to a mode of construction of composite fountain blades (16), by means of independent strips (17), endowed them with perfect flatness of their active parts and displacement, through their full range of use, with good parallelism with the fountain roller, and also independent adjusting mechanisms to control these independent strips, these same independent adjusting mechanisms being, if desired, equipped with eccentric discs (28, 29), support mechanisms for the scraper spatulas and disposable fountain liners and removable fountain blocks with automatic adjustment and retention of the sides of the disposable fountain liners, and also threaded sleeves providing mechanical support for the adjusting screws and a reduction in their movement.

15 Claims, 12 Drawing Sheets

INKING DEVICE FOR A PRINTING PRESS

SUMMARY OF THE INVENTION

This invention concerns the ink fountains acting as an ink reserve and supply to printing presses, sheet-fed, continuous, offset, letterpress or similar, and relates to the mode of construction of their blades, which are segmented by inking zone, characterized by the fact that these blades are composed of a set of independent strips, each of which represents an individual inking zone. A further distinctive feature of these composite blades is the fact that the active part of each strip presents a perfect plane surface and moves geometrically across the full travel of its zone of utilization along an axis perpendicular to that of the fountain roller with which the blades cooperate. Furthermore, by reason of the invention, adjustment of the displacement of each of these independent strips regulating the flow of ink is effected by an adjusting mechanism which is principally characterized by the fact that it is fully independent and can be installed rapidly in place each adjusting screw of the existing fountain, whatever its length, without the need for any mechanical modification to the fountain or the press, such as drilling, thread cutting, milling, etc., or any special knowledge on the part of the installer. These independent adjusting mechanisms are also characterized by the fact that, according to application, they may or may not include a second eccentric disc enabling easier and more precise adjustment of the fountain or cams regulating ink flow as desired over the whole of their inking zone, thereby permitting the use, if desired, and without changing the initial position of the fountain blades, of a disposable fountain liner, designed to cover the fountain roller during use so as to protect it and avoid the necessity for cleaning after use, or to be easily removed from the press for cleaning and re-used several times.

Another purpose of the invention concerns the construction of removable ink fountain blocks which, principally by means of their shape, enable them to fit without adjustment a fountain roller and an inking roller which may be similar or different in length, in order to ensure imperviousness of the fountain, thereby avoiding the difficulty and loss of time involved the precise adjustment of these two components which is vital for the avoidance of leaks when traditional fountain blocks are used. These removable fountain blocks are of particular interest as substitutes for traditional fixed fountain blocks and enable rapid conversion of used fountains, whose rollers have generally undergone machining causing changes to their original length in the process of maintenance over a period of time. These removable ink fountain blocks hold in position the flaps of the disposable fountain liner, which is adapted to the shape of these blocks and their mode of operation to ensure that no ink escapes on to the edges of the fountain blade.

Another purpose of the invention concerns the creation of disposable fountain liners characterized by the fact that their cut shapes, folds and side flaps are disengaged from the angles of the active part of the fountain blades and those of the removable fountain blocks and the surfaces of the fountain rollers in order to avoid ink runs and to enable operation in combination with the removable fountain blocks.

With the same end in view and to facilitate the necessary evacuation of ink residues contained in the fountain before the fountain roller can be removed for cleaning or to remove the liner, this set of features is completed by a scraper spatula possessing two functions, the first being the evacuation of the ink and the second the scraping of the fountain roller to de-ink and clean it. This scraper spatula, a product of the invention, may also be equipped with a supporting mechanism common to that of the liner, enabling it to be positioned and held in place in the same way as the latter. This mode of operation enables considerable simplification of this tedious task, saving cleaning rags and solvents as well as time, in this way increasing the productivity of these printing presses.

Another purpose of the invention concerns the creation of threaded sleeves to be screwed in as replacements for the original adjusting screws of the fountain. These sleeves provide two principal functions, one to support, guide and ease the movement of the adjusting screws replacing the original screws, to endow these assemblies with easy mechanical operation by suppressing the present stiffness caused by the fact that the active part of these screws or their thrust tips is strongly compressed between the fountain blade and the heel of the fountain blade support, the other, which is optional, to provide a variable, pre-set reduction for the movement of these screws, diminishing the effort required to operate them and considerably increasing the precision of adjustment of the flow of the ink film. These threaded sleeves use the same principal of mechanical operation as the independent adjusting mechanisms and are used when, for reasons of economy or lack of space, independent adjusting mechanisms cannot be installed.

All or part of this equipment can be installed directly during manufacture of the printing presses or rapidly fitted to existing printing presses, even by the users themselves.

DETAILED DESCRIPTION OF THE INVENTION

Figure 1:
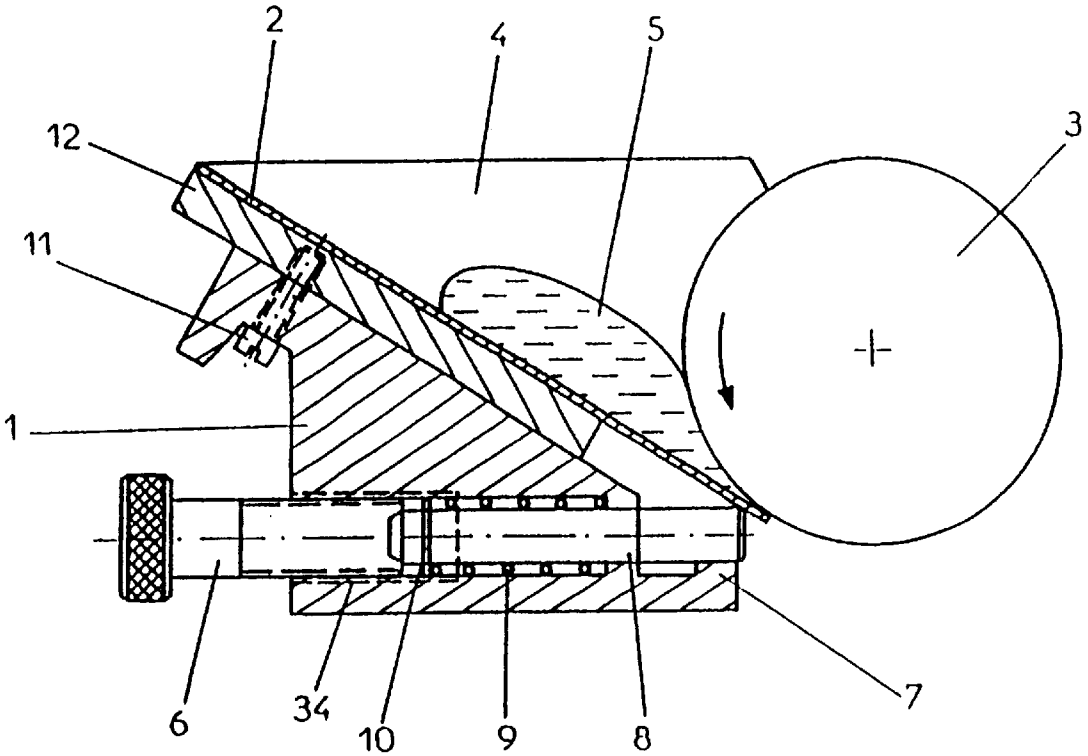
Figure 1 (Prior Art)
FIG. 1 is a cross-sectional view of a traditional printing press.

At present, the great majority of traditional printing presses are equipped with a fountain body 1 FIG. 1 supporting a fountain blade 2 of fairly thin steel sheet (of the order of one and a half to two millimetres), working pressed against a metal fountain roller 3 upon which the ink reserve 5 sits and is rolled out to form a film between the tip of the fountain blade 2 and the fountain roller 3. At each end of the fountain body 1 a flange 4 is fixed retaining the ink reserve 5. Adjusting screws 6 positioned all along the fountain blade, 2 at intervals of about thirty millimetres between centres, carried by the fountain body 1, which comprises tapped holes for the purpose, regulate the thickness of the ink film by zones, by exerting variable pressure. These adjusting screws 6, supported on the heel 7, act either directly on the fountain blade 2 or through the intermediary of a thrust pin 8 joined to the adjusting screw 6, usually returned by a spring 9 kept under compression by a Truarc clip 10. A series of screws 11 fixes the fountain blade 2 to the fountain body 1. The fountain blade 2 is in one piece with its blade support 12.

Figure 2:
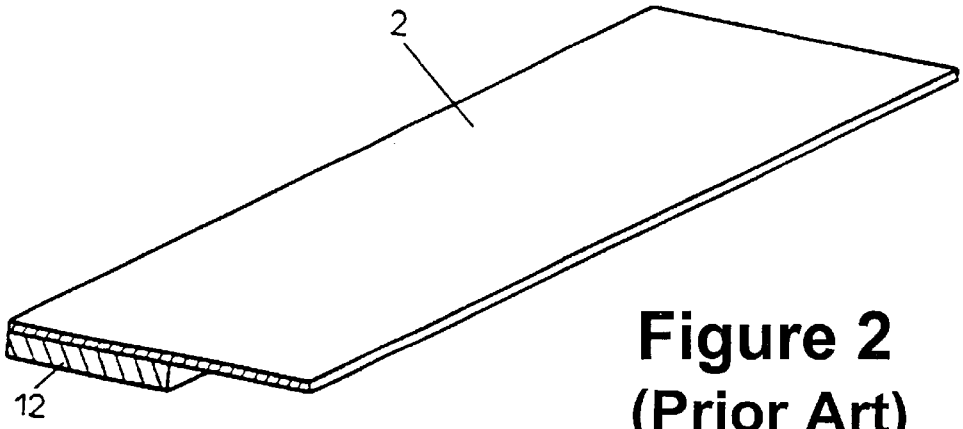
Figure 2 (Prior Art)
FIG. 2 is a perspective view of a traditional fountain blade.

FIG. 2 shows a traditional fountain blade 2 fixed to its blade support 12. This very simple system of ink distribution presents the following drawbacks:—during regulation of the thickness of the ink film, the fountain blade 2, made of steel sheet of high mechanical strength, and all in one piece, is subjected to stresses by the action of the adjusting screws 6 and is distorted in haphazard fashion in some places, thereby creating inking zones of indefinite width, whose irregular and unstable thickness, caused by imprecise adjustment, leads to considerable loss of time and spoiled material. This regulation is rendered all the more hit-and-miss by the fact that adjustment of one adjusting screw 6 interferes with the adjustment of neighbouring zones, the lack of reduction in the control system leads to a reduced range of adjustment, rendering this already delicate operation even more imprecise. These inadequacies of precision and regularity of ink film emission are extremely prejudicial to the optimization of printing quality.

Aware of these weaknesses, the manufacturers of modern printing presses destined for high quality industrial printing have equipped these presses with sophisticated devices, working on the principal of independent inking zones, emitting a sufficiently even and unvarying ink film across the whole inking zone, the fountain comprising remote controls acting on each section of the inking zone by the use of miniature geared motors which continually correct the slight deviations in their ink flow. These devices, which are extremely costly, are not compatible with the mass of printing presses with which the great majority of printing works are equipped.

Figure 3:
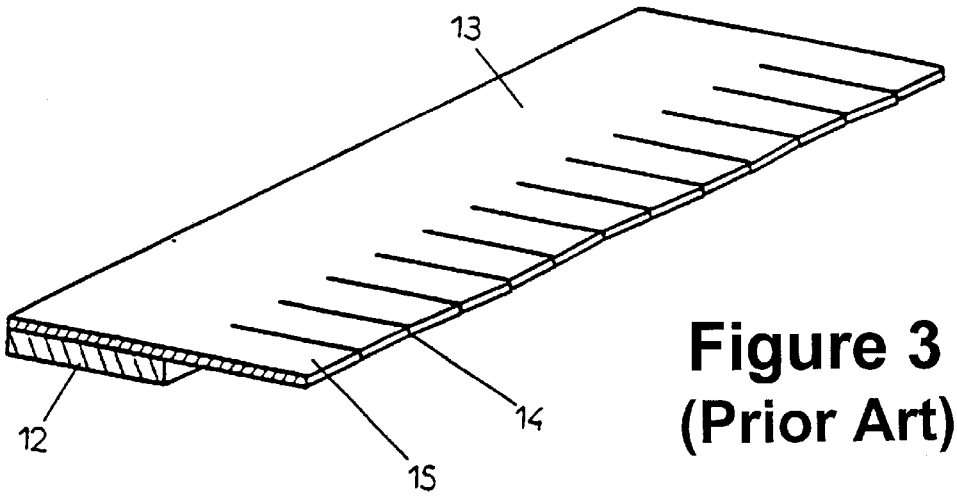
Figure 3 (Prior Art)
FIG. 3 is a perspective view of a traditional fountain blade comprising slots.

More recently, these same makers of printing presses have equipped the smaller models of presses with fountains possessing fountain blades 13 FIG. 3, constructed similarly to the fountain blades 2 FIG. 1, but further comprising slots 14 FIG. 3 dividing up the fountain blade 13 into independent sections, whose ink flow is regulated by eccentric discs acting in a similar manner to the original adjusting screws 6 FIG. 1 on thrust pins 8. To the same end, some printing equipment specialists offer fountain blades 13 FIG. 3 comprising slots 14 as substitutes for the original fountain blades 2 FIGS. 1 and 2, each section being controlled either by the original adjusting screws 6 or by a mechanical assembly incorporated in the fountain to transform it, acting on thrust pins 8 via eccentric discs. These fountain blades 2 or 13 consist of a blade of hard steel such as tempered, polished spring steel, glued or electrically spot-welded to a blade support 12 FIGS. 2 and 3, made from semi-hard steel. The slots 14 in the fountain blades 13 are cut before or after these fountain blades 13 are fixed to their blade support 12, either by laser beam or by wire electrical discharge machining. One of the major disadvantages resulting from the machining of these slots 14 is the uncontrolled partial release of the internal tensions in these tempered steels, due to the fact that the parts above these slots 14, linking these blade segments, remain in one piece with the fountain blade 13 and are therefore prevented from functioning freely and independently, entailing distortion and irregular misalignment of the active part of the blade sections 15, which leads, in each inking zone, to uneven ink flow highly prejudicial to the correct operation of these fountain blades 13. Unfortunately this defect cannot be corrected during the final grinding, as the magnetic tables or fixing flanges supporting these fountain blades 13 have to clamp them firmly for grinding. This strong mechanical clamping during grinding momentarily corrects these defects, but they reappear as soon as the fountain blades 13 are released from the magnetic tables or fixing flanges. These differences of alignment are shown, intentionally exaggerated, in FIG. 3 in order to make clear the nature of the defect. These differences from one segment to another may in reality be of the order of five hundredths to two tenths of a millimetre, which may seem small, but are sufficient to cause genuine difficulties in use, whether the fountain blades 13 concerned are those originally fitted to the printing presses or are substitutes fitted on machines already in use in place of the original fountain blades 2. Indeed, to achieve good printing, it is very important that the adjustments to ink flow in each zone should be of the order of a few hundredths of a millimetre. These fountain blades 13, even if straightened before grinding, either by measured deformation in the opposite direction or by hammering, do not display linear movement right across their range of use because the metal, even when straightened, does not recover sufficient inertia and partially retains its distortions. This is also true of fountain blades 13 ground in by the printer on the printing press, directly on the fountain roller 3, as some manufacturers recommend, a negative remedy which also has the serious disadvantage of spoiling the polish and damaging the surface of the fountain roller 3, without really solving the problem. Furthermore, attempts to render the metal inert and release these tensions before machining of the slots 14 by annealing in vacuo to eliminate these distortions during machining of the slots 14 are ineffective due to the small thickness of these fountain blades, of the order of one and a half to two millimetres, and their length, which induce even greater distortions of the metal.

In addition, in cases where eccentric cams are added to existing fountains with the aim of controlling each segment of the fountain blade 13, the fact that the mechanisms used are attached to the fountain body 1 in groups and, unlike the adjusting screws 6 of the latter, do not therefore form an integral part with respect to each inking zone, the variable stresses applied to adjust each segment of the fountain blade 13 accumulate and are transmitted to the components supporting these groups, which then tend to yield, so that as one segment is adjusted, slight but uncontrollable modifications tend to be transmitted to the ink flow settings of the others. These serious defects nullify much of the benefit derived from these fountain blades 13 functioning by zones and discourage their potential users from buying them, so that it becomes advantageous to create truly plane composite fountain blades 16 FIGS. 4, 5 and 6, offering regular displacement parallel to the axis of the fountain rollers 3 across their full range of operation.

Another major disadvantage limiting the industrial development of the conversion of existing fountains is due to the fact that the incorporation of devices to control the fountain blades 13 by means of eccentric discs necessitates the execution of machining operations such as drilling, tapping, countersinking, etc. on the printer's premises, or alternatively the dismantling of the fountain so that it can be taken to the machine shop for such operations, or for additional processes such as grinding, monopolizing the press for the time being. Similarly, after new blades have been fitted to used fountains, precise adjustment of the lengths of these blades has to be carried out in order to match them to the real lengths of those of the fountain rollers, since a small difference of some hundredths of a millimetre between these two components in sufficient to affect imperviousness, permitting leaks which are unacceptable to the printer. Such delicate adjustments can only be effected by a professional mechanic. These mechanical modifications to presses are generally distrusted by the printer, who feels he is taking risks without knowing how effective these modifications really are, not having been able to test them under real conditions in his business. This negative psychological parameter often cancels out the desire to attempt such modifications, although when properly carried out they can bring great improvements to the use and quality of the inking function of the printing press. There are at present tens of thousands of printing presses which could easily benefit from these low-cost improvements.

Another fault criticized by the users, both those using presses with blades segmented during manufacture and those who have modified their fountains, is the low amplitude of movement of the ink flow adjustment, due to the fact that the eccentric discs can only effect about a quarter or a third of their angular movement and therefore, for fine adjustments, demand very small movements of the control levers of these eccentric discs, of the order of less than a millimetre, rendering these adjustments very laborious. But in order to avoid wasting more expensive paper than necessary, and to save time, it is important to be able to achieve a good inking profile rapidly. This defect is an especial nuisance on professional printing presses designed to produce high quality print, for which precise inking of each printing zone is imperative. The purpose of the invention described here is to correct these defects in order to boost the industrial development of this equipment, by providing a set of devices which can be incorporated, in their entirety or in part, either directly during manufacture of the printing presses, or rapidly, even by the printer himself, without carrying out mechanical modifications of any kind on the press.

Figure 4:
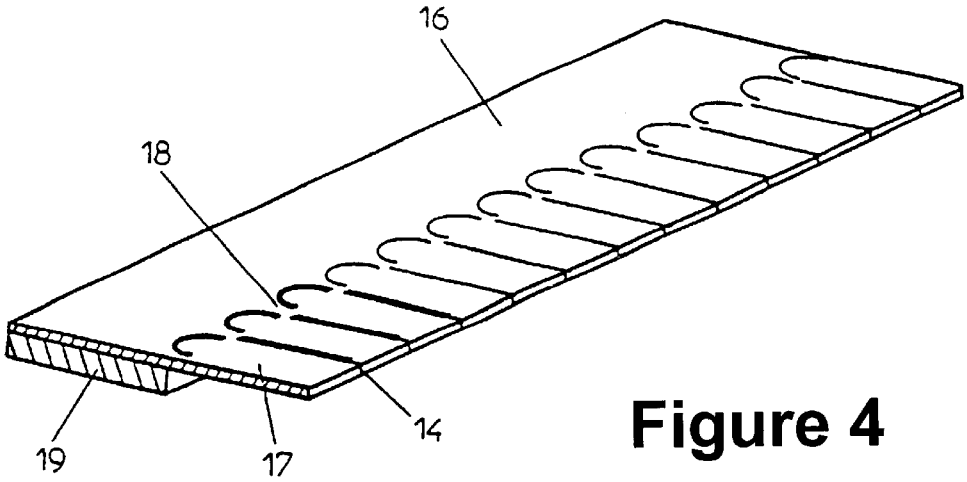
FIG. 4 is a perspective view of a fountain blade formed with cut-out independents strips.
Figure 5:
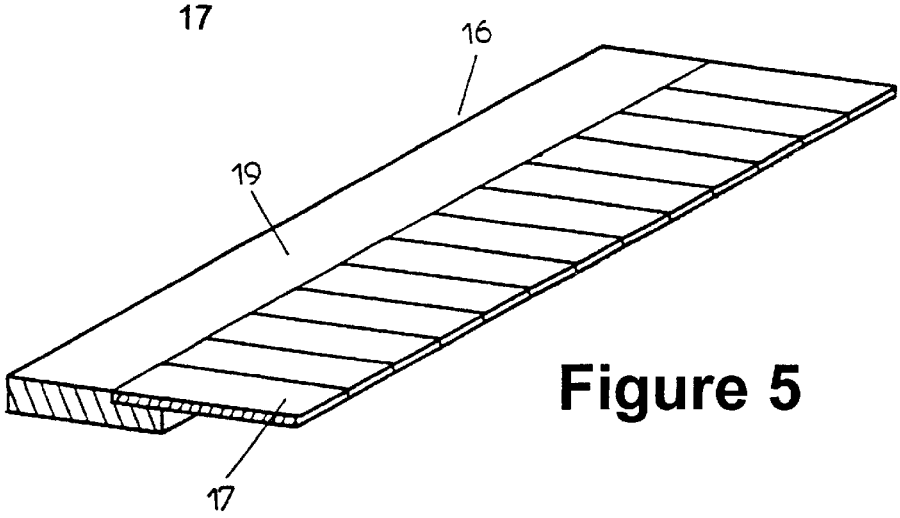
FIG. 5 is a perspective view of a fountain blade formed with detached independent strips.
Figure 6:
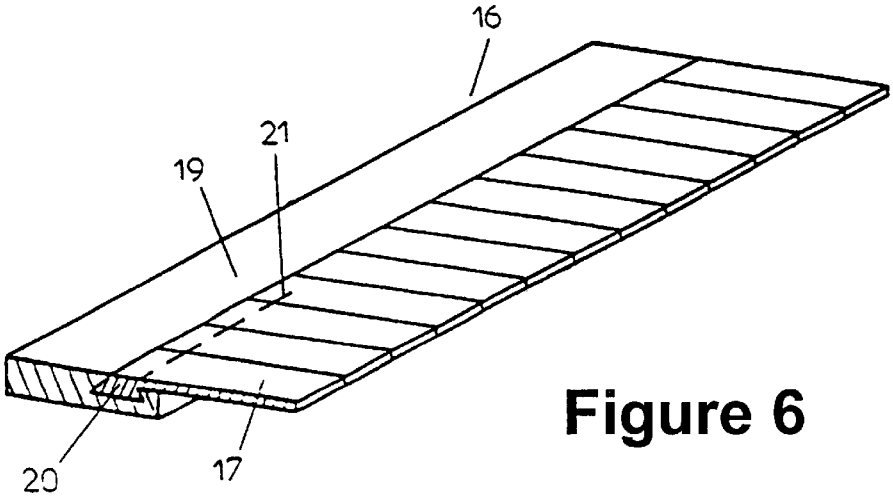
FIG. 6 is a perspective view of a fountain blade formed with dovetailed independent strips.

To correct the defects relating to the use of fountain blades 13, different methods are described by way of non-exclusive examples, with reference to the attached drawings, of obtaining composite fountain blades 16 FIGS. 4, 5 and 6, which remain perfectly inert and geometrically plane after grinding and enable precise, regular displacement of their active parts.

The principle of the mode of construction of these composite fountain blades 16 is based on the fact that, whatever mode of construction is adopted, the set of independent strips 17, before fixing to the blade support 19, is either sufficiently separated from the rest of the composite fountain blade 16 or constitutes the latter directly, so that each independent strip 17 operates freely without extraneous stresses.

FIG. 4 shows a composite fountain blade 16 in which each independent strip 17 is first cut out, by laser beam, for instance, leaving just the points of attachment 18, so that this fountain blade, cut out and separated, can be manipulated. The blade support 19 having first been ground flat on both sides, the blade, before being reconstituted, is positioned and clamped on to the blade support 19 to fit its perfect flatness before assembly by adhesive, electrical spot welding or other means. In this mode of execution of the invention, each independent strip 17 is released from its tensions incurred during the cutting out of the composite fountain blade 16, due to being no longer connected to it except by the narrow points of attachment 18. After assembly, the composite fountain blade 16 is subjected to grinding and filling of the slots 14, either in the same way as the present fountain blades 13, with an elastomer of silicone, polyurethane or other substance, or by the means comprised in the invention.

FIG. 5 shows another mode of execution of these composite fountain blades 16, avoiding the need for filling the slots 14, enabling the achievement of perfect juxtaposition of each independent strip 17, thereby eliminating the formation of a bead of ink on the fountain roller 3 opposite each slot, which leaves a superfluous thickness of ink and hinders cleaning of the fountain after use. In this mode of construction of a composite fountain blade 16, each independent strip 17 is squared and its edges are finely ground and polished to machining tolerances of a few hundredths of a millimetre, the same process being applied at least to its under surface which is destined to be assembled to the blade support 19. Grinding and polishing will be particularly thorough on the edges of these independent strips 17 which are to be juxtaposed and must then be able to move independently, without mechanical effort, despite being assembled under slight pressure against each other. This assembly on the blade support 19 is generally executed with the aid of a means to hold them in the right position with respect to the blade support 19 and in contact with each other. The part of the blade support 19 on which the independent strips 17 are assembled is straightened and finely ground before they are attached by means of adhesive, electrical spot welding or other means. These composite fountain blades 16 are then ground before use and display very good mechanical operation, not permitting the passage of greasy, viscous printing ink between the independent strips 17.

FIG. 6 shows this same type of composite fountain blade 16 in which the blade support 19 and the independent strips 17 include, in addition, a machined dovetail 20, facilitating assembly and guaranteeing that the independent strips 17 are mechanically secured in a durable manner with respect to the blade support 19, whatever the method of assembly adopted: by adhesive, electric spot welds or other means, since for correct operation each independent strip 17 must be solidly fixed to its blade support 19. These mechanical fastenings, such as those resulting from the inclusion of a dovetail or similar device, enable the length of the independent strips 17 to be reduced by the maximum, while at the same time ensuring that they are perfectly fixed, since in this configuration, the adhesive may be omitted, if desired, since its only purpose is to avoid the need for unnecessarily precise, costly machining. During assembly by adhesive, this mode of procedure is the most rational, since whatever the nature of the adhesives used and the preparatory treatments applied to improve the strength of adhesion between these very small surface areas, which are later to be subjected to considerable tractive stresses tending to detach them, the risk of detachment of these steel parts is ever-present. Similarly, the mode of assembly of FIGS. 4 and 5 can benefit from some kind of mechanical fastening, either by means of a dovetail, or for example by including an insert, of metal or other material, between the composite fountain blades 16 and their blade support 19.

In these different modes of construction of these composite fountain blades 16, the geometrical accuracy of the methods used is all-important, and principally in the examples in FIGS. 5 and 6, designed to compose precision fountain blades in which each independent strip 17 demands precision machining comparable to that required for the manufacture of mechanical parallel bars, and for which assembly on the blade support 19 must also be executed with precision and attention to detail if these assemblies are to function properly.

The mode of execution shown as a non-exclusive example in FIG. 4 concerning the construction of a composite fountain blade 16, based on a complete blade whose independent strips 17 have been released from their internal tensions by cutting before assembly to the blade support 19 enables industrial production which is simpler, quicker and less costly than that of the examples in FIGS. 5 and 6 in that it greatly reduces the amount of machining, such as the relatively lengthy and expensive grinding operations, makes assembly easier and nevertheless retains the main advantages of these composite fountain blades 16.

In a variant mode of execution of the invention, FIG. 4 intentionally shows the first three slots 14 of the composite fountain blades 16 carried out in two different widths, with the aim of reducing the with of the beads of ink on the fountain roller 3 resulting from these slots when they are cut by laser beam. In fact, the slots 14 cut by laser beam are about three tenths of a millimetre wide, while those produced by wire electrical discharge machining are three hundredths of a millimetre wide or more, but cost ten times as much as the former. The invention described here offers four intermediate methods, non-exclusive, making it possible to dispense with these slots or conserve them, while greatly reducing their width, in order to avoid the resulting ink beads.

The first method consists in cutting the main part of each slot by laser beam, but cutting the narrower last two to three millimetres to the opening by wire electrical discharge machining.

The second method consists in shearing the last two to three millimetres after cutting by laser beam. In this economical technique, the composite fountain blade 16 is made from slightly thicker metal, of the order of five tenths of a millimetre, enabling the traces left by low amplitude shearing to be eliminated by cheap, coarse-grain grinding. These two techniques provide, at modest cost, the same advantage as that obtained by cutting these slots 14 directly in very small widths by electrical discharge machining, without having to pay the high costs.

The third method, which is interesting in that it reduces the width of the slots 14 to a minimum, consists in reconstituting each independent strip 17, and filling up the space resulting from the slot 14, leaving just an operating clearance of the order of one hundredth of a millimetre or less. Without affecting the principle of the invention, this reconstitution can be carried out using any filling material fixed to one of the two surfaces of the slot 14 by any appropriate method. As examples, two modes of operation which give good results are described below:

a) one of the two surface of the slot 14 is protected, either for example by a film of MYLAR or steel foil of thickness of the order of a hundredth of a millimetre or by deposition of thin film of mould release agent such as silicone or similar before the slots 14 are filled with, for example, a very hard structural adhesive, such as epoxy or similar. After the adhesive or other substance has hardened, in the case of the use of a protective film of MYLAR, foil, etc., the latter is removed and the blade cleaned or ground. This mode of procedure, while it prevents the viscous ink from passing through the filled slots 14, eliminates the need, as at present, to provide the underside of these slots 14 with an additional bead of elastomer of silicone, polyurethane or other substance to guarantee that the blade remains leak-tight over time, these beads causing considerable difficulty during cleaning of the underside of the tip of the active part of these blades. With this technique, the glue or sealant adhering to one of the two surfaces of the slot 14 is not subjected to much stress, and therefore does not demand very high adhesive strength.

b) the other mode of operation consists in reconstituting these independent strips 17 by rebuilding one of the two surfaces of the slot 14 using pre-cut shims of metal or other substance and glued or brazed by low-temperature brazing of the order of one hundred and fifty degrees centigrade to one of the two surfaces of the slot 14, in this case also leaving a very small operating clearance. This operation is performed before grinding and enables filling of the space due to the slots 14 between these independent strips 17.

The fourth method consists in eliminating the slots 14 in the surface of the fountain blade, at least in its active part, in order to prevent the formation of the resulting beads of ink on the fountain roller 3. To achieve the same end, it is known in fountain blades designed in the same way as the fountain blade 13 FIG. 3, whose slots, however, are of the order of two to three millimetres wide. These fountain blades are covered by having a film of spring steel foil, thickness of the order of a few hundredths of a millimetre, fixed by adhesive to the surface. These fountain blades, like the fountain blades 13, display the same defects of misalignment of their active parts, entailing irregularities of parallelism with respect to the fountain roller 3. Furthermore, the irreversible gluing of a thin sheet of steel foil to the fountain blade is very difficult to perform and holds considerable risks of unreliability over a period of time.

In this fourth method, the type of composite fountain blade 16 FIG. 4 possesses slots 14 which stop about five millimetres short of the edge of the active part of the independent strips 17. In this five-millimetre zone, in the prolongation of the slots 14 which have no opening, the underside of the composite fountain blade 16 is thinned down over a width of one to two millimetres until a thickness of metal of about one tenth of a millimetre is left, measured from the upper surface of the composite fountain blade 16. Another version of this mode of execution consists in breaking down the internal tensions in the metal without allowing the slots 14 to come right through to the upper surface of the composite fountain blade 16. This may be done, for example, by replacing the use of the laser beam by milling over a width of three millimetres, leaving a thickness of four to five tenths of a millimetre of metal at the surface, this thickness then being reduced, as in the previous example, to about one tenth of a millimetre over a width of one to two millimetres and to a height of about five millimetres from the side of the composite fountain blade 16 comprising the active part.

If this fourth method in either of its two versions is to function correctly, it is essential to employ a spring steel which, even when its thickness is small, retains its characteristics which enable it to be deformed sufficiently to absorb the differences in level of each inking zone. Another interesting variation of this invention consists in cutting complementary slots 21, shown on the first independent strips 17 FIG. 6, calculated as a function of the width and length of the independent strips 17 to be treated, the purpose being to optimize the mechanical functioning of these assemblies, since under these conditions the independent strips 17 are subjected to stresses only in the direction of the axes of the thrust pins 24. This complementary slot 21 should preferably be filled with a polyurethane-type elastomer, hardness of the order of seventy to eighty Shore D, very much greater than that used for filling the slots 14, which is generally of the order of eighty Shore A, since in this case the function of the elastomer is to immobilize the independent strip 17 in the right position while permitting it, by its slight deformation, to bend slightly, so as to accompany but not impede the tiny movement of the upper part of the independent strip 17, at the same time preventing it from deviating from its axis. In the same way, an epoxy-type structural adhesive, of a type selected to retain a "horny" consistency in the adhesive film, can give the blade firm support while obliging it to move evenly along the axis of the thrust pin 24. By the usual method of filling the slots 14, binding them elastically to each other, the elastomer must deform easily so as not to influence the neighbouring independent strips 17, which is not the case with the methods of filling comprised in the invention and used to fill the slots 14 constituting the independent strips 17 while joining them freely together. The complementary slots 21 may be used in any method employed to create independent strips 17, such as the examples, which are not exclusive, shown in FIGS. 4, 5 and 6 to illustrate the invention. Of course, the examples provided in illustration of the invention are not exclusive and the forms shown of the independent strips 17 and the points of attachment 18, the method of filling their slots 14 and the complementary slots 21 are all very variable and may be complemented or replaced by any other means enabling the unwanted stresses in the metal to be broken down, such as, for example, thinning down by zones under these independent strips 17 at the edge of the parts fixing them to the independent strip support 19, while remaining within the scope of the invention insofar as these methods serve to destroy these tensions before the independent strips 17 are assembled to the independent strip support 19.

Figure 4A:
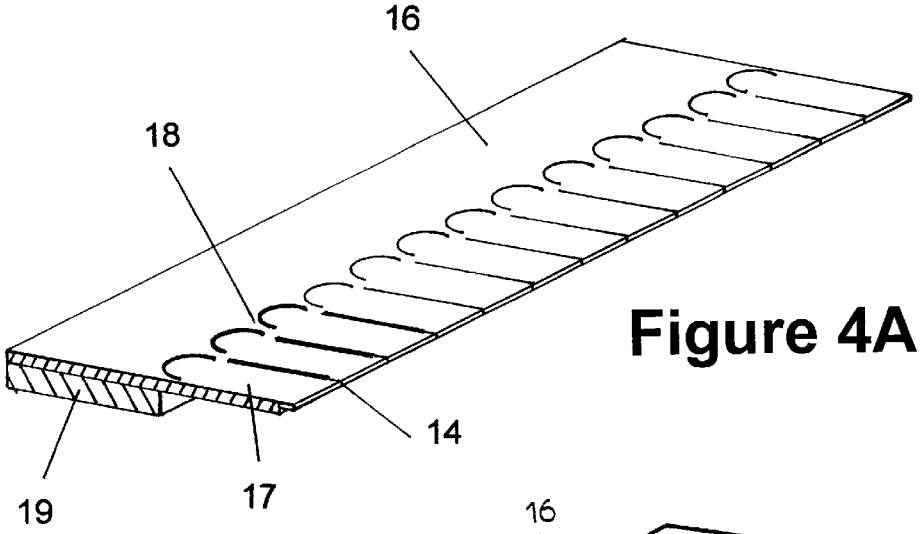
FIG. 4A is a perspective view of a fountain blade formed with cut-out independent strips according to another embodiment.

FIG. 4A shows an alternative construction where an underside of the fountain blade 16 in a region where the slots 14 end to the distal edge has a reduced thickness to ensure the strips are subjected to only stresses in an axis of displacement. As with the embodiment of FIG. 4, this embodiment intentionally shows the first three slots 14 of the composite fountain blade 16 carried out in two different widths.

As regards the adjustment control of the different composite fountain blades 16 FIGS. 4, 5 and 6 substituted for the original fountain blades 2 FIGS. 1 and 2, the mechanical principle of operation adopted and characterizing the invention is the replacement, without any mechanical intervention, of the original adjusting screws 6 by the independent adjusting mechanisms 22 rigidly attached to and supported by individual zones on the fountain body 1 in order to exert a force on it in the same way as the adjusting screws 6, comprising the whole set of components enabling it to act on the displacement of the independent strips 17 and installed in replacement of these adjusting screws 6. These independent adjusting mechanisms 22 may also be used purely and simply as replacements for the original adjusting screws 6, while retaining the fountain blade 2 for reasons of economy, which, at the very least, enables a substantial improvement in the ease and precision of adjustment of inking by zones to be achieved.

Another characteristic of the invention is that, on printing presses producing high quality output, it facilitates the fine adjustment of ink flow by using the independent adjusting mechanisms 22, equipped with eccentric discs 28 and 29, each of which individually controls the whole inking range. The eccentric disc 28, for example, controls fast approach to the general inking profile, while eccentric disc 29, by providing a high reduction ratio, offers good angular amplitude for great precision and ease of use.

Figure 7:
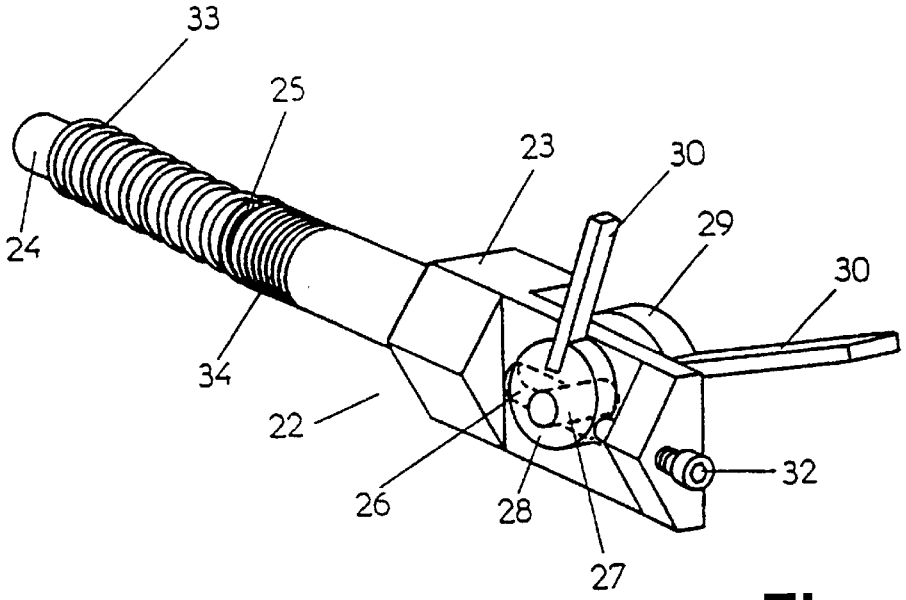
FIG. 7 is a perspective view of an adjusting mechanism with dual eccentric discs.
Figure 9:
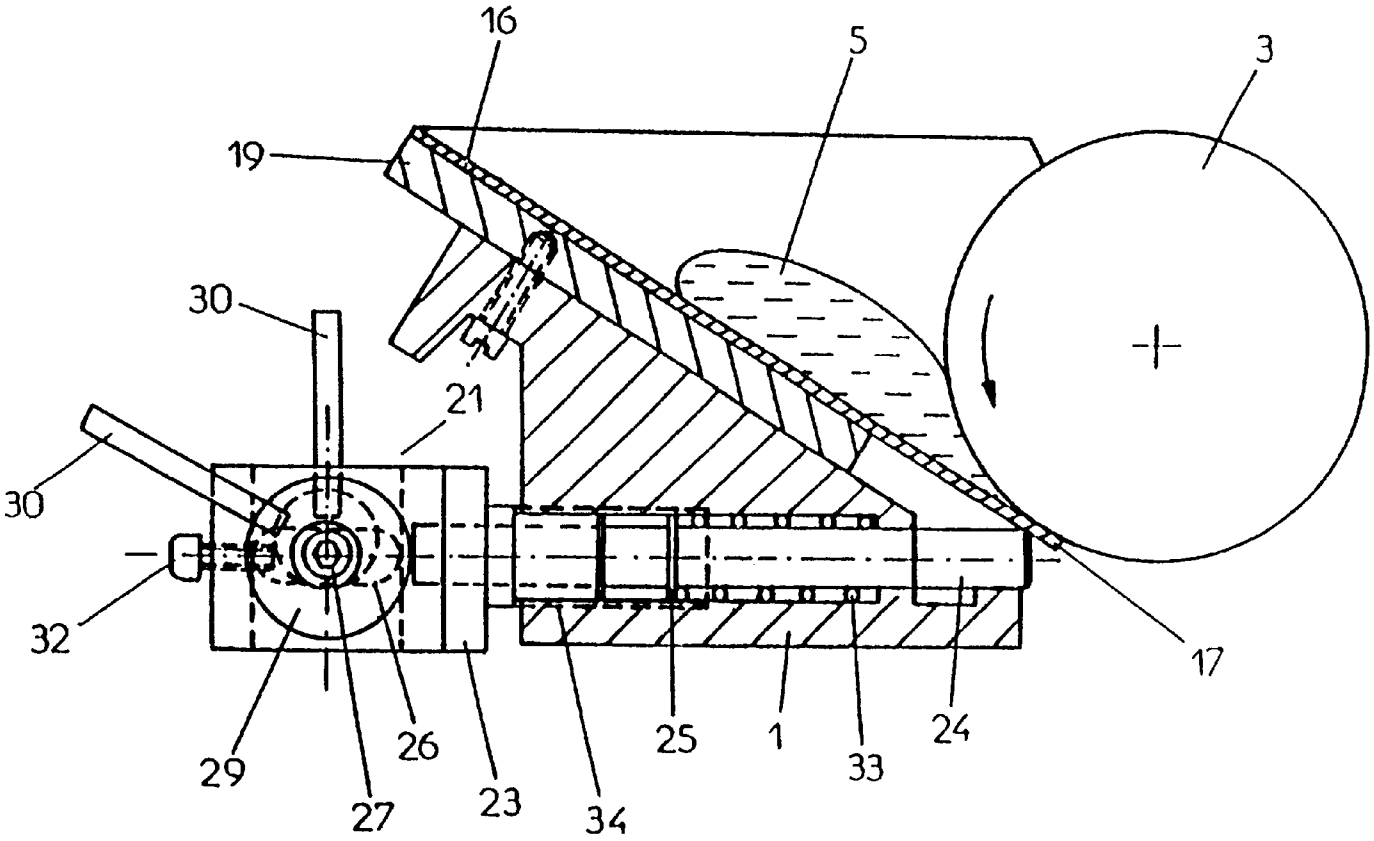
FIG. 9 is a cross-sectional view of a printing press according to the invention showing the use of the adjusting mechanism of FIG. 7.
Figure 10:
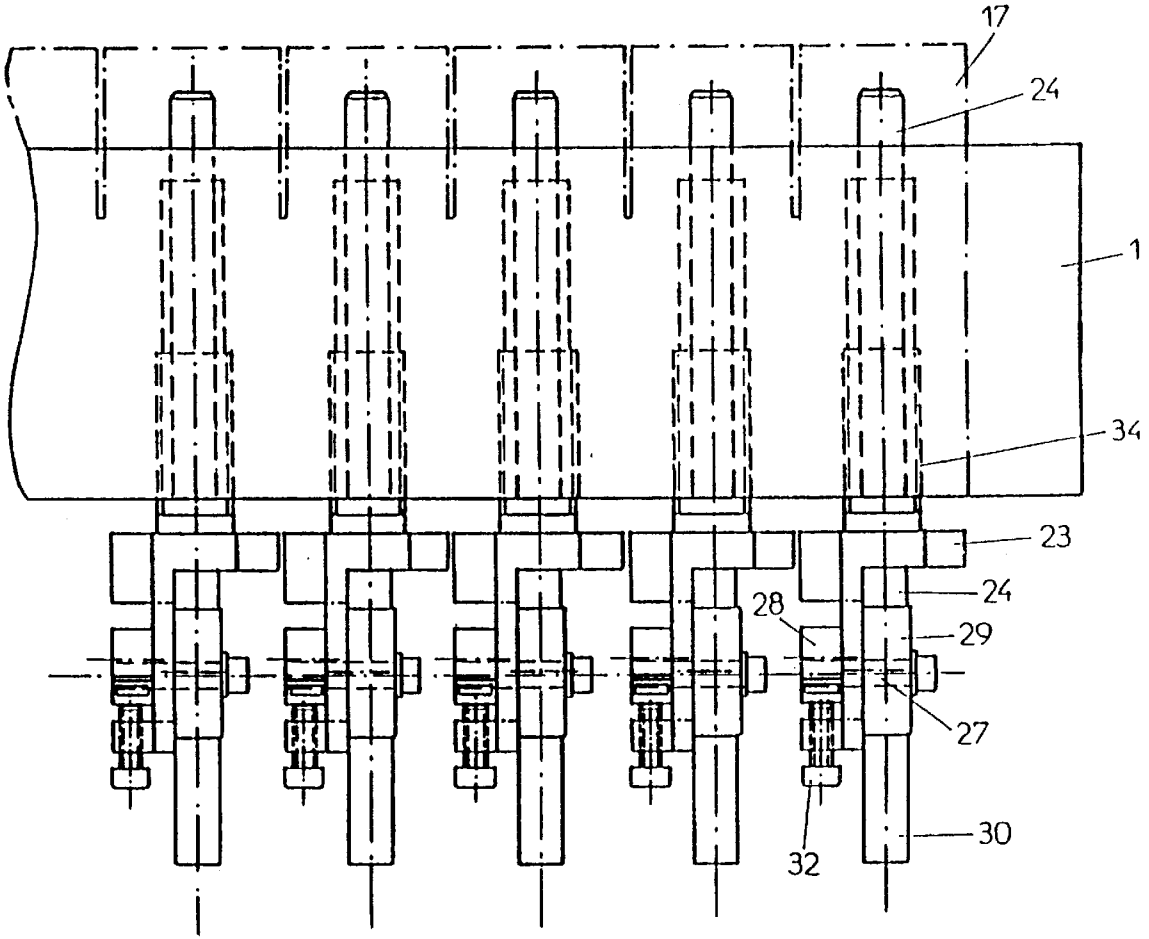
FIG. 10 is a top view of a series of independent adjusting means in the printing press.
Figure 11:
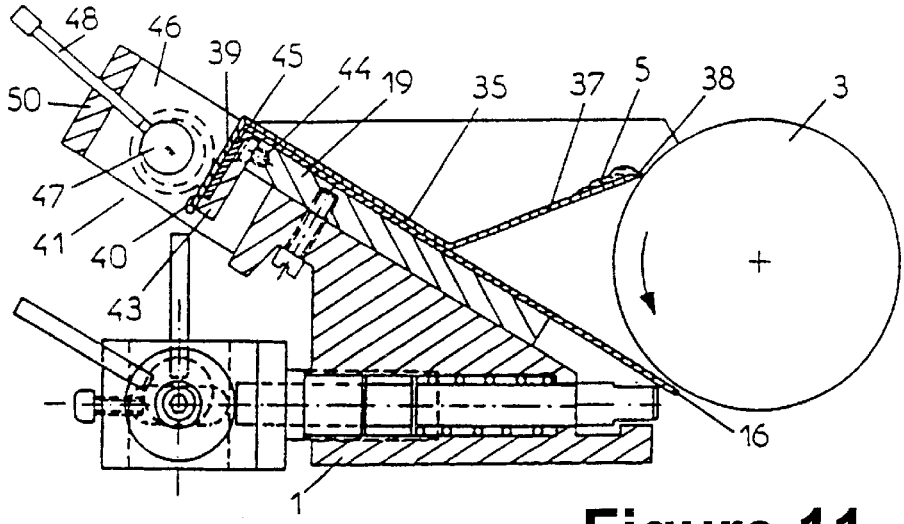
FIG. 11 is a cross-sectional view of a printing press of the invention using a scraper spatula.
Figure 12:
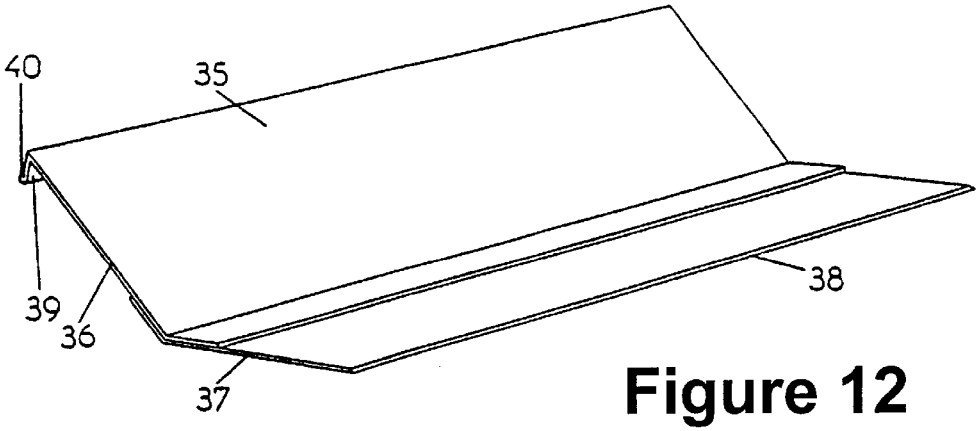
FIG. 12 is a perspective view of the scraper spatula shown in FIG. 11.
Figure 13:
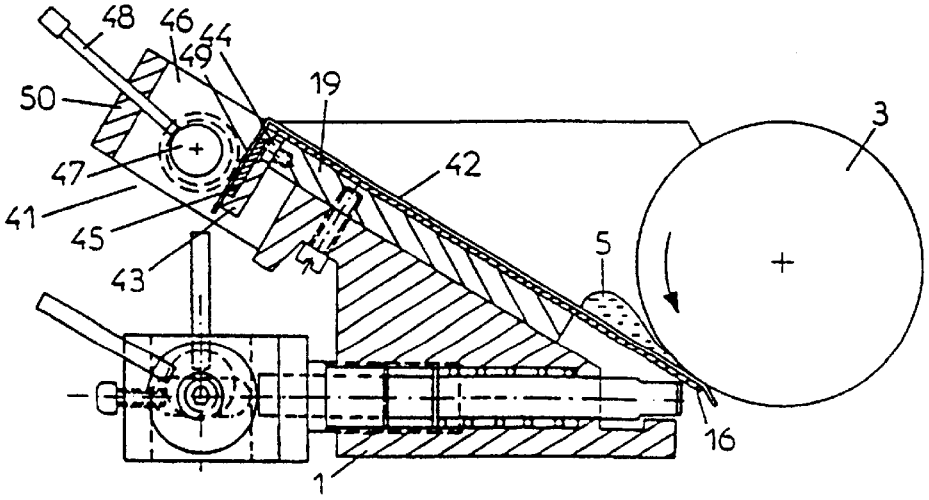
FIG. 13 is a cross-sectional view of a printing press of the invention showing the fountain blade covered with a fountain liner.

FIGS. 7, 9 and 10 show a complete independent adjusting mechanism 22, comprising a support 23 carrying a sliding thrust pin 24 fitted with a travel limiting clip 25 and a return spring 33. These three components 24, 25 and 33 function respectively in the same way as the original components 8, 9 and 10, the essential difference residing in the fact that the thrust pin 24, unlike the original thrust pin 8, is not mounted on the adjusting screw 6 and is closely guided along its axis, with a low degree of operating play, enabling the independent strips 17 to be displaced accurately along their transverse axes, thereby eliminating the risk that they may be tilted and misaligned by the eccentric thrust resulting from the thrust pins 8. The support 23 of the independent adjusting mechanism 22 is milled on two of its surfaces and comprises a slide 26 supporting the spindle 27 which slides in it, carrying the eccentric discs 28 and 29, each of which is fitted with a control lever 30. The overall eccentricity required is about six tenths of a millimetre which is sufficient, by the action of an eccentric disc 29 or the two eccentric discs 28 and 29 on the thrust pin 24 to displace the extremity of the independent strips 17 and obtain between the latter and the fountain roller 3 a space variable from zero to about four tenths of a millimetre, necessary to obtain a good range of inking. The eccentric disc 28, for fast approach, will be eccentric by about four and a half to five tenths of a millimetre, and the eccentric disc 29, for small movements, by about one to one and a half tenths of a millimetre, thereby enabling ink flow to be finely adjusted with accuracy. A housing, marked with one or two graduations according to the use of the eccentric disc or discs 28 and 29, covers the whole of these independent adjusting mechanisms 22 and is fixed to the supports 23, independently of the printing press. These independent adjusting mechanisms 22 also provide for the very important option of being able to use, or refrain from using, disposable fountain liners 42, using either composite fountain blades 16 or fountain blades 2, avoiding the need for cleaning them after use, and furthermore without obliging the printer, if he should temporarily have run out of disposable liners, to carry out adjustments before being able to use his fountain by displacing these composite fountain blades 16 or fountain blades 2 and adjust the setting of each of the zone adjusting devices with which these fountains are equipped. According to size, a fountain may have about fifteen to thirty of these, so that this operation represents an unacceptable waste of effort and time during use of a printing press. When used in this way, the setting of the low-eccentricity eccentric disc 29, for fine adjustment of the ink flow, will be retained, while the eccentric disc 28, strongly eccentric, will provide a complementary displacement of the order of a tenth of a millimetre, compensating for the thickness of the disposable fountain liner 42. To facilitate the use of these independent adjusting mechanisms 22, this difference in position of the control lever 30 corresponding to the thickness of the disposable fountain liner 42 will be marked on the graduations on the housing that covers all these mechanisms. In all cases, and principally in the case of disposable fountain liners 42 used with a single eccentric disc 28 or 29, its eccentricity will be so positioned as to ensure that its bottom dead centre does not delay the immediate opening of fountain blades 2, 13, 16 and others, thereby enabling maximum reduction of angular movement of the eccentric disc 28 or 29 and its control lever 30 at the start of opening, in the zone corresponding to the thickness of the disposable fountain liner 42, and reserving the greatest possible range for adjustment of the active zone. To the same end, the eccentric disc 28 or 29 can, though at some additional cost, be replaced by a cam in substitution, which can provide rapid opening of fountain blades 2, 13, 16 or others for a small angular displacement corresponding to the thickness of the liner adopted.

To the same end, another characteristic of the invention which, in the case of a single eccentric disc 28 or 29 provides a real improvement in the precision of adjustment obtained in the zone of common use, is, either with or without a disposable fountain liner 42, also to replace the eccentric disc 28 or 29 by a cam designed to modulate the adjustment of ink flow by preferential inking zones, across its full range of adjustment and in accordance with the quantity and type of frequent printing operations for which the presses to be equipped will be used, since, by way of non-exclusive example, in reality and in the great majority of cases and in normal printing, the fountain only operates across about fifty per cent of its adjustment range, which makes it possible to design cams taking these variable factors into account and enabling reductions to facilitate precision of adjustment in the active zones. This intermediate measure may, but need not, be combined with a second adjustment cam or eccentric disc 28 or 29 with high reduction ratio, which in all cases provides great precision of the fine adjustment by means of its wide amplitude of movement.

Figure 8:
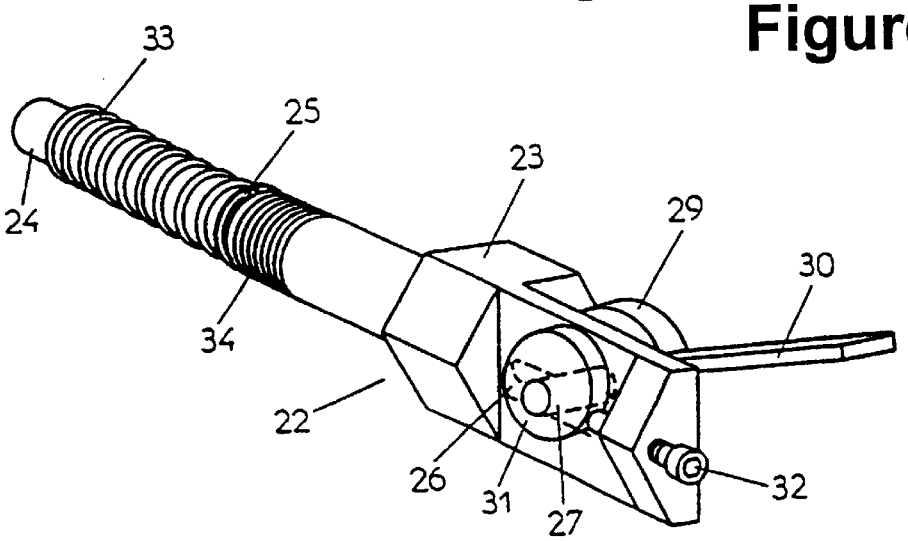
FIG. 8 is a perspective view of an adjusting mechanism using a single eccentric disc.

FIG. 8 shows the same independent adjusting mechanism 22 with the difference that the spindle 27 only carries a single eccentric disc 29 with complete eccentricity of about six tenths of a millimetre and a non-eccentric disc 31 replacing the eccentric disc 28 FIG. 7. The function of the adjusting screw 32 FIGS. 7 and 8 is to displace the eccentric disc 28 or the non-eccentric disc 31, to adjust the initial position of the thrust pin 24 which is constantly drawn back by the combined action of the return spring 33 and the independent strip 17 which also acts as a spring. The thread 34 cut in the support 23 of the independent adjusting mechanisms 22 has the same pitch as the original adjusting screws 6 FIGS. 1 and 2. For the purpose of improving the mechanical performance of the thrust pin 24, the support 23 in which it slides is equipped at both ends with ball or TEFLON bearing in order to enable it to slide extremely smoothly, reducing the thrust force and avoiding the necessity for its operation for it to rest and press on the heel 7 of the fountain body 1 as the original thrust pins 9 do. This mode of procedure entirely liberates the independent adjusting mechanism 22 and enables it to function autonomously, accurately, gently and consistently with the aid of the return springs 33, which are reduced in strength by at least half due to the fact that the thrust pin 24 is no longer, as at present, strongly gripped between the fountain blade 2 and the heel 7 and is ready to withdraw as soon as the active part of the eccentric discs 28 or 29 releases it. This is all the more advantageous in the conversion of fountains since the heel 7 on which the original steel thrust pin 9 moves and is permanently compressed has often become quite seriously damaged over time and no longer fulfils its original function properly. Intentionally, and with the aim of avoiding unnecessary complication of FIGS. 7 and 8, the ball or TEFLON bearings have not been shown since they contribute nothing to comprehension of the mechanism operation of the independent adjusting mechanisms 22. To improve the mechanical functioning of these assemblies, composite fountain blades 16 and independent adjusting mechanisms by inking zone 22, the composite fountain blades 16 or others are also characterized by the fact that, after grinding and before use, they are subjected to specific grinding-in of their active parts with abrasive media using, for optimization of this operation, grains of the order of five microns grade, thereby producing blades ready for immediate use. This avoids the present need, in certain cases, to carry out a grinding-in operation directly on the printing press before use, which has the negative effect of damaging the fountain roller 3, working in combination with the fountain blade 13, due to the fact that the grinding pastes used have grains of large size in order to attain an improvement in functioning, though this is very imperfect, in a relatively short period of one or two hours. This treatment on its own cannot eliminate the defects due to the poor flatness of these fountain blades 13 resulting from their method of manufacture which causes their mechanical malfunctioning. Furthermore, the hardness of the fountain roller 3 is not sufficient to enable it to withstand this mechanical treatment unharmed.

The grinding-in of the composite fountain blades 16 or others is performed in two operations, of which the first consists in lapping, for example with polishing wheels, the two sides of their active angle carried out over several millimetres, which is sufficient in the case of blades covered by a disposable fountain liner 42 able to operate in "one cut". In this case, the angle is only lightly softened, since the disposable fountain liner 42 itself provides a layering function. For fountain blades able to operate, according to circumstances, either with or without a liner, a second grinding-in operation is carried out, in the same geometrical position as during use. A grinding-in assembly capable of holding the composite fountain blade 16 or other precisely in position, taking into account the same pre-stresses of each of its independent strips 17 with respect to a driven grinding-in roller replacing the fountain roller 3 provides a very good way of performing this finishing operation. The grinding-in roller is the same diameter as the fountain roller 3, but its surface hardness is very much higher, and it is made of steel, preferably covered in a ceramic material or subjected to a surface treatment giving it a surface hardness of the order of sixty to seventy Rockwell so that the grinding paste is unable to attack it. This grinding-in roller is finely ground and polished and driven in continuous rotation, unlike a fountain roller 3 which is driven intermittently through a small angle at each printing cycle, so that on composite fountain blades 16 or others whose construction has conferred good flatness on them, the grinding-in process is performed with precision in a short time.

The cleaning of the fountain body 1 and its fountain roller 3 has always been a chore for the printer, since the manual removal of the residue of the ink reserve 5 with a small spatula and the cleaning of the fountain roller 3 covered with a thick layer of greasy printing ink, viscous and sticky, requires the use of rags and solvents and constitutes a lengthy and unpleasant task. The invention described here offers a simple solution to this problem, since it can easily be fitted to any type of printing press, making these functions very much easier. To illustrate the invention, two non-exclusive modes of procedure and devices, based on the same principle, are given by way of example, with references to the attached diagrams FIGS. 11, 12, 13, 14 and 15. The scraper spatula 35, which is the same length as the composite fountain blades 16 or others, is made, for example, of a piece of stainless steel sheet 36 about one millimetre thick on to which is fixed by electrical spot-welding the active part 37, made from, for example, stainless spring steel sheet of the order of five tenths of a millimetre thick, with a scraping zone 38 having a sharp scraping angle. The rear part 39 of this scraper spatula 35 is bent through ninety degrees and has a pressed fold 40 so that the user may not suffer injury to his hands. The composite fountain blade 16 or other is equipped with a support mechanism 41 for the scraper spatula 35 or the disposable fountain liner 42. The support mechanism 41 consists of a support beam 43, fixed by screws 44 to the rear of the independent strip support 19 or any type of fountain blade. This support beam 43 is machined to contain an elastomer band 45 and carries two flanges 46, each one provided with a bore supporting an eccentric spindle 47, equipped with a control handle 48 which, when operated, causes the eccentric spindle 47 to pivot so as to clamp and firmly hold between the crest of the eccentric and the support beam 43 the rear part 39 of the scraper spatula 35 or the ninety-degree pressed fold 49 of the disposable fountain liner 42. The elastomer band 45 contained in the support beam 43 compensates for differences in thickness between the pressed fold 49 of the disposable fountain liner 42 and the rear part 39 of the scraper spatula 35. A spacer 50 completes and gives strength to these mechanisms. Before cleaning the fountain, whether or not it is fitted with a disposable fountain liner 42, the scraper spatula 35, in a single movement, removes almost all the residual ink reserve 5 which can then be removed from it by the use of a hand-held spatula, working in liberty off the press on a bench covered with a slip sheet. The scraper spatula 35 is then set to scraping position, pressing lightly against the fountain roller 3, and held in place by the eccentric spindle 47. The fountain roller 3, rotated either manually or by actuating the printing press, is cleaned, without solvents, of its residual layer of ink reserve 5 in a few revolutions. This ink can be removed directly with a spatula from the scraper spatula 35 and cleaning is completed with a small quantity of solvent.

Figure 14:
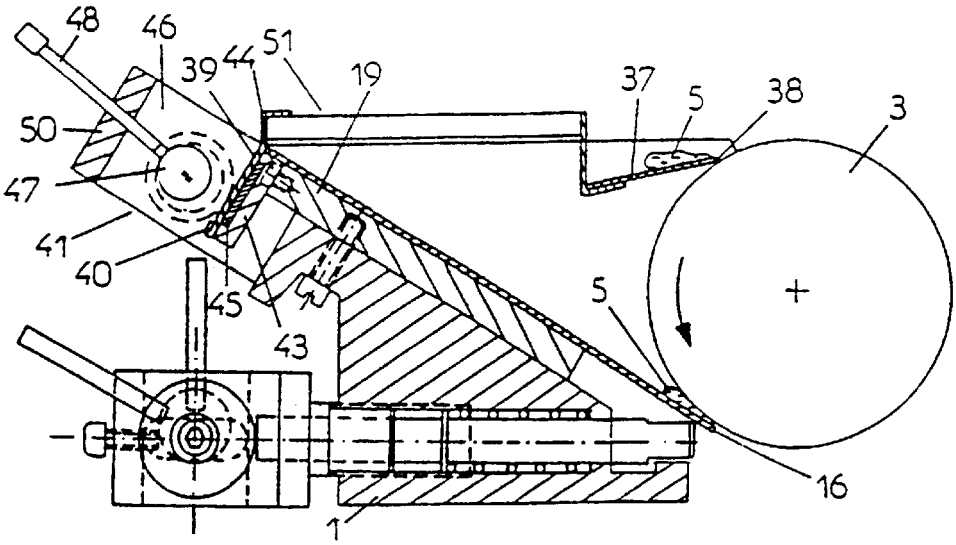
FIG. 14 is a cross-sectional view of a printing press of the invention using the scraper spatula of FIG. 15.
Figure 15:
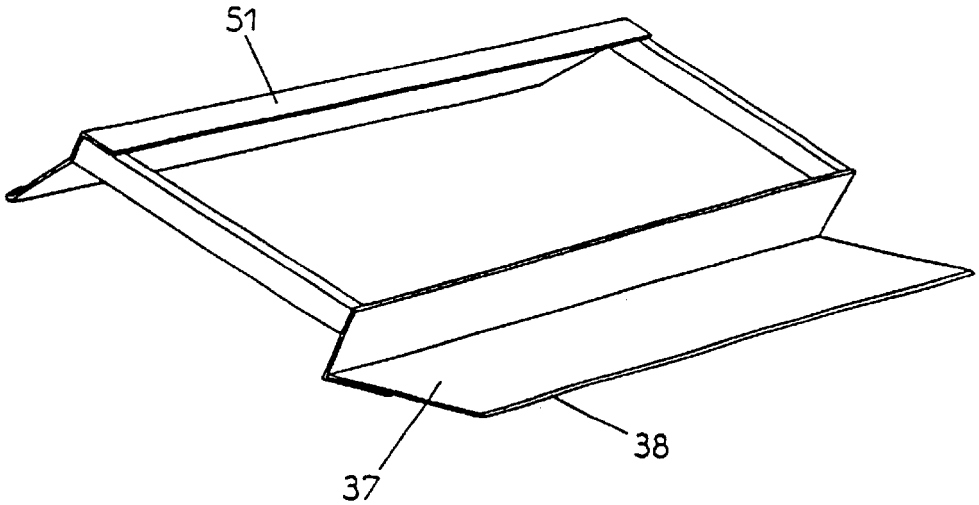
FIG. 15 is a perspective view of the scraper spatula shown in FIG. 14.

A variation on this method can be performed if the printer prefers to remove all the residual ink reserve 5 directly, bit by bit, on the scraper spatula 51 FIG. 14. In this case, the scraper spatula 51, disengaged in order to allow free access over the fountain so that a manual spatula can be used, is positioned and held in the same way as the scraper spatula 35. Before scraping, the fountain body 1 is slightly separated from the fountain roller 3 before the residual ink reserve 5 is pushed against it with the manual spatula, until it is all completely taken up by the scraper spatula 51.

All sorts of variations can be introduced into these modes of operation and this same type of scraper spatulas 35 and 51 can be used for example manually, without using the support mechanism 41 or can be employed for these same functions, individually in two parts, one serving as a spatula, covering all or half of the fountain blade, according to length, and the other as a scraper covering the whole length of composite fountain blades 16 or others, while remaining within the scope of the invention.

Figure 16:
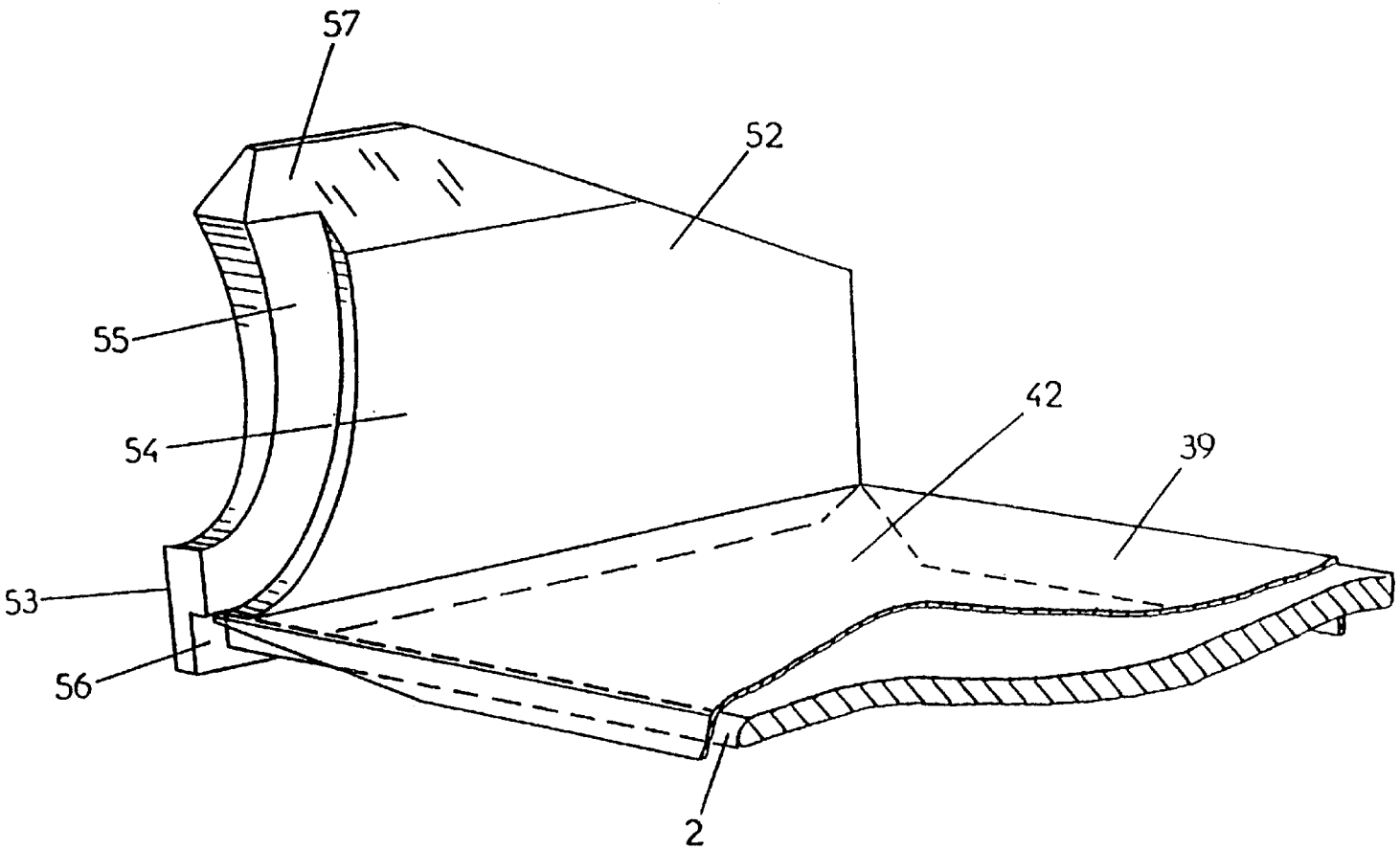
FIG. 16 is a partial perspective view of a removable fountain block.

FIG. 16 shows a removable fountain block 52 having two plane faces 53 and 54 parallel to each other. In face 54, the throat 55 is accurately machined in an arc of a circle to a depth of the order of two to three millimetres and a width of about six to eight millimetres, against which, in operation, the surface of one of the sides of the fountain roller 3 is pressed. This machining operation is executed at a slant, in order to obtain an oversize of the upper part of the throat 55 of approximately six tenths of a millimetre. In operation, the groove 56 covers one of the edges of the fountain blade 2 and is deeper by about six tenths of a millimetre than the lower part of the slant in the throat 55. The slope 57 acts, as in the case of the fixed blocks of traditional fountains, to scrape residual ink away to the side and return it to the fountain. The point of the acute angle formed between the throat 55 and the groove 56 meets the active edge of the fountain blade 2 and rests against the fountain roller 3. The differences in depth between the groove 56 and the lower and upper parts of the slant in the throat 55 perform the function, by means of their shape, of automatically absorbing any difference in length between the fountain blade 2 and the fountain roller 3, these differences being potentially, with the machining described, of the order of one millimetre more or less between these two components (for example, for a fountain roller 3 with a length of five hundred millimetres, the fountain blade 2 might be between four hundred and ninety-nine and five hundred and one millimetres long to operate properly), any leakage being prevented by the fact that, in all cases, the slanted throat 55 remains pressed against the surface of one of the sides of the fountain roller 3 and the fountain blade 2 is covered by the groove 56. The point of the acute angle formed by the groove 56 and the throat 55, in contact between the fountain blade 2 and the fountain roller 3, absorbs a good part of the pressure exerted by the rolled ink and thereby contributes to ensuring imperviousness. In practice, it is rare, even on very old printing presses, to come across differences in length between the fountain blade 2 and the fountain roller 3 greater than about five tenths of a millimetre. If need be, the differences in length between the fountain blade 2 and the fountain roller 3 may be greater than the two millimetres given by way of non-exclusive example to illustrate the invention, on condition that the dimensions of the removable fountain blocks 52 are modified, while substantially respecting the same proportions between the throat 55 and the groove 56 as those described in the example above.

The machining dimensions given as guidelines concern the creation of removable fountain blocks 52 which work solely by reason of their shape and are made of some hard substance such as metal. The dimensions may vary as a function of the nature of the material. It is obvious that the same blocks, if made from a substance such as elastomer, which itself deforms to absorb all or part of the differences in length between the fountain blade 2 and the fountain roller 3, may, as a function of the rigidity and hardness of the material employed, function properly on the basis of moulding or machining dimensions which may be different and variable according to the material adopted, the purpose in all cases being to ensure static and dynamic imperviousness between the surface of the fountain roller, the supporting surface of the removable fountain block and the active edge of the fountain blade.

These two parameters, the effects of the shape and deformation of the material, may also, in accordance with the greater or smaller differences in length to be absorbed between the different components and materials employed, combine to attain good results. The advantage of using a hard material working by reason of its shape lies in the fact that it offers high mechanical stability and reliability over time.

Figure 17:
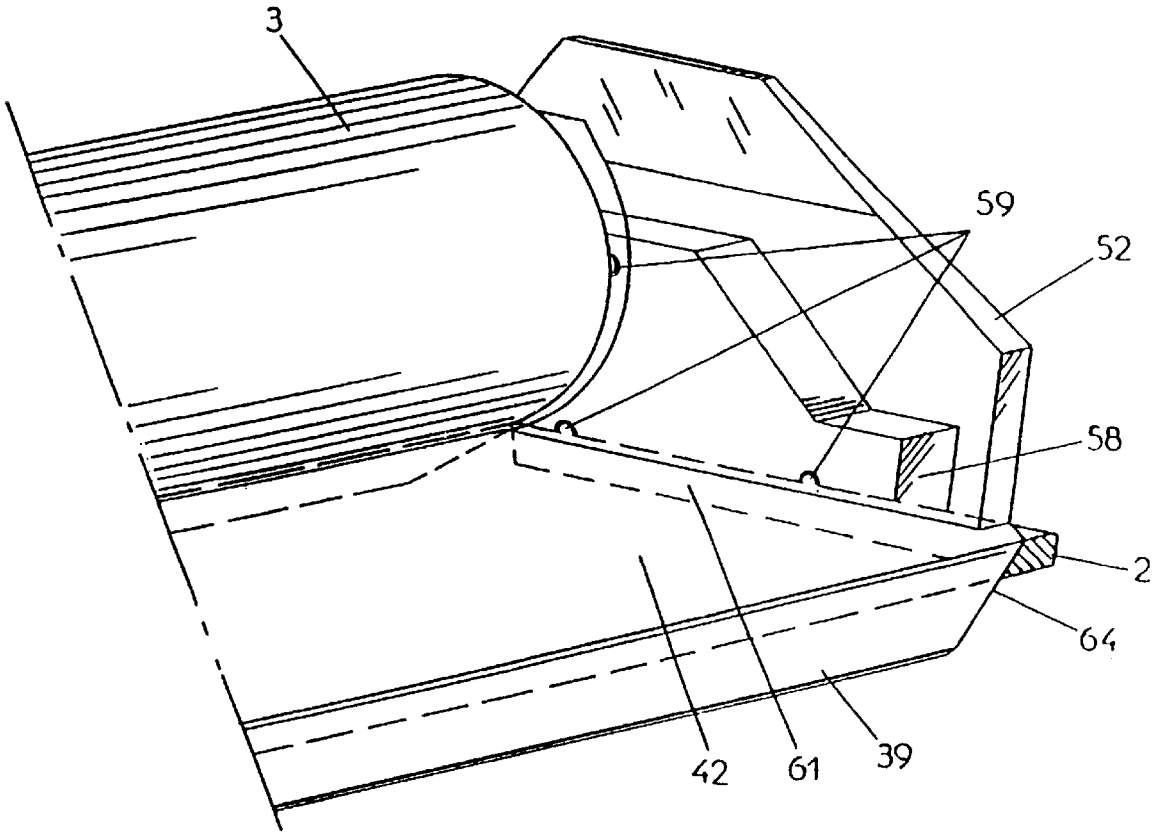
FIG. 17 is a partial perspective view of a removable fountain block installed on the fountain.

FIG. 17 shows the removable fountain block 52 installed in operating position on the fountain. The fixed stop 58, provided with spring loaded studs 59, is fixed in place of the original fixed fountain block, leaving enough space between the fixed stop 58 and the fountain blade 2 to introduce the removable fountain block 52, and keep it under pressure, exerted by the springs of the spring loaded studs 59, against the surface of the sides of the fountain roller 3 and the edge of the fountain blade 2. The tabs 61, at each end of the disposable fountain liner 42 covering the fountain blade 2, are folded, clamped and covered by the removable fountain block 52 which holds them firmly in place and, by covering them, ensures that no ink can get inside and soil the edges of the fountain blade 2.

Figure 18:
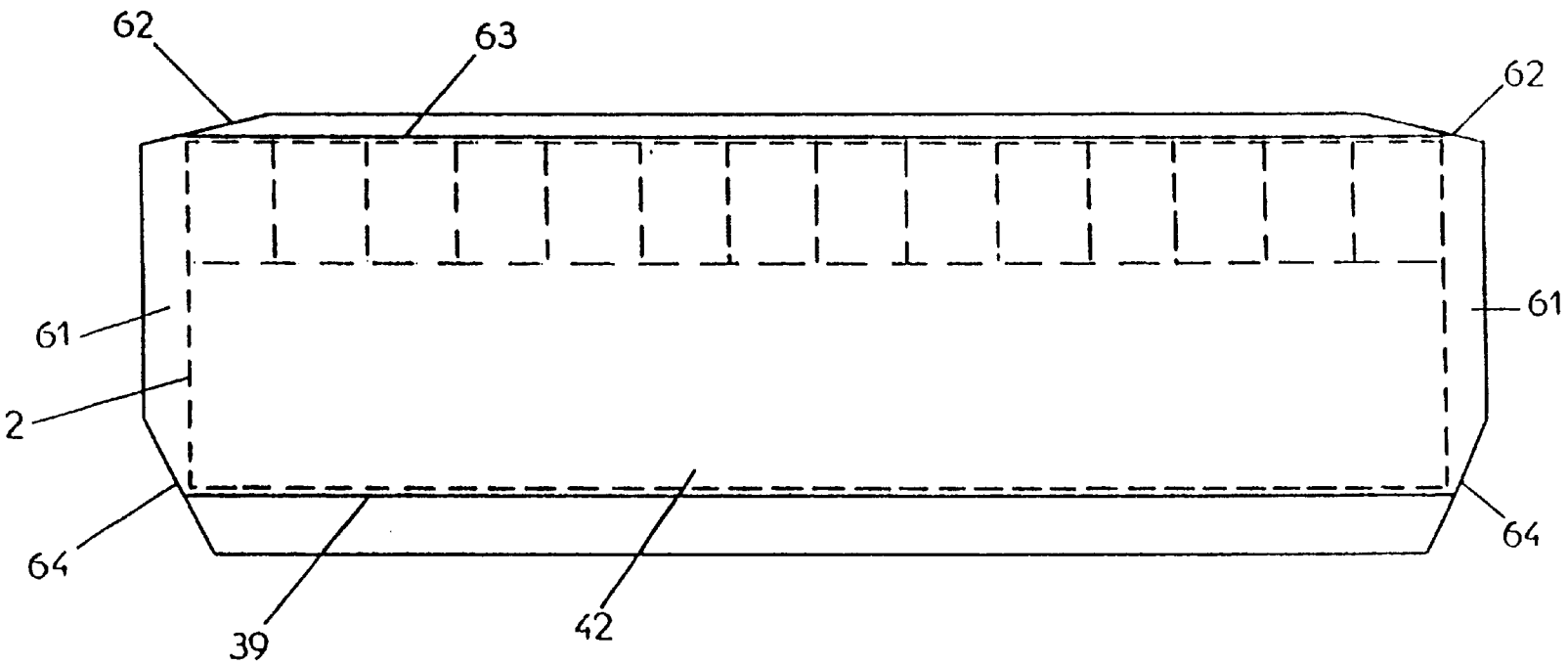
FIG. 18 is a top view of a disposable fountain liner.

FIG. 18 shows a non-exclusive example of a form of disposable fountain liner 42, placed on top of the fountain blade 2, characterized by the fact that it possesses tabs 61 which are longer each side than the length of the fountain blade 2 by the thickness of the latter so that, in combination with the removable fountain blocks 52, they stretch and keep in place the sides of the disposable fountain liner 42. The cut flaps 62 are well clear of the two active corners of the fountain blade 2 and also of those of the removable fountain blocks 52 and surfaces of the fountain roller 3, in order to avoid any contact which might cause a build-up of ink which could then run and fall inside the printing press. The cut flaps 62 extend beyond and cover by a slight margin of about two millimetres the ends of the two right-angle corners of the active part of the fountain blade 2. The fold 63 is clear of the edge of the disposable fountain liner 42 in order to avoid contact with the surface of the fountain roller 3. The fold 63 and the cut flaps 64 hold in place and remain clear of the corners of the rear part of the disposable fountain liner 42. The positions of the cut flaps 62 and folds 63 and 39 require accuracy of manufacture of the disposable fountain liner 42, as they determine its correct positioning with respect to the fountain blade 2 and thereby directly influence the correct operation of the whole. The cut flaps 62 and 64 may be replaced by indentations or any other shape provided that, in the part of the cut flaps 62, they leave sufficient clearance from the corners of the active parts of the fountain blades 2 and also of those of the removable fountain blocks 52 and the extremities of the fountain roller 3, in order neither to cause runs of ink nor, by their shape, to favour the natural flow of ink by the force of gravity.

The removable fountain blocks 52 and disposable fountain liners 42 improve ease of use and cleaning of fountains due to the fact that the fountain blade 2, after use, always remains clean and does not wear, and that the fountain roller 3 and removable fountain blocks 52 can be delivered in dual sets, so that the user can start the next print run quickly and clean them while the press is printing. Of course, in case of a shortage of disposable fountain liners or should the printer so desire, the removable fountain blocks 52 can be used in the same way without a disposable fountain liner 42.

For these reasons, they advantageously replace traditional fixed fountain blocks and can be installed, without any mechanical modification to the printing press, as a substitute for these on presses in service, or can replace them during manufacture of the printing presses, since they then avoid the need for precise adjustment with the fountain roller 3 in the event of replacement of the fountain blade 2, and automatically ensure that the fountain is leak-proof.

Figure 19:
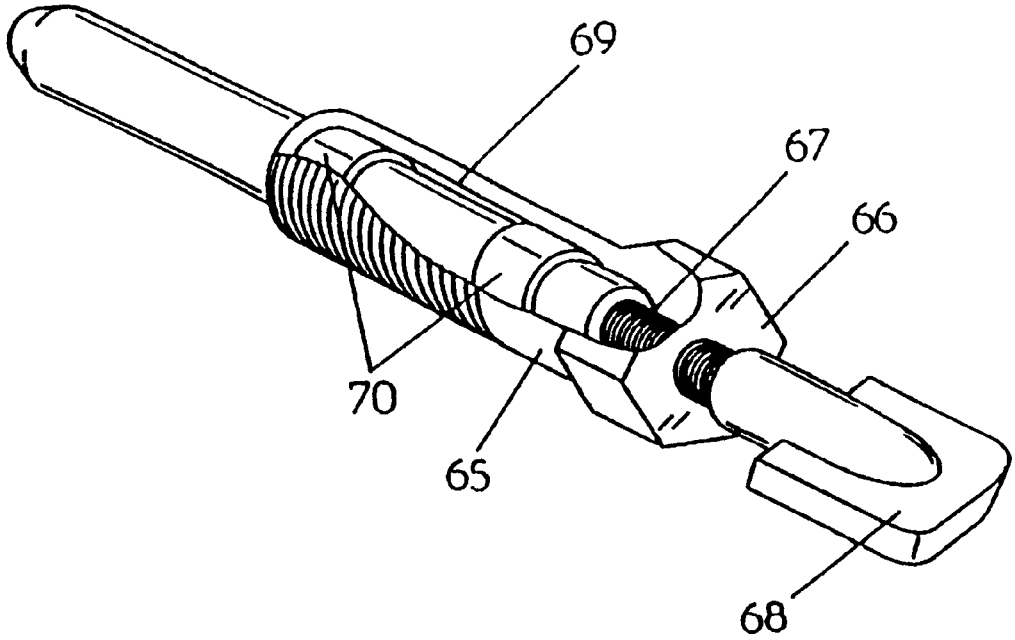
FIG. 19 is a partial perspective view, with parts broken away, of a threaded sleeve.

FIG. 19 shows the threaded sleeve 65 carrying the adjusting screw 68 and contributing a mechanical function to it. This threaded sleeve 65, threaded at the same pitch as the original adjusting screw 6 FIG. 1 of the fountain, comprises a tubular body 66 with a thread 67 having a finer pitch than that of the threaded sleeve 65, thereby providing a reduction of the movement of the adjusting screw 68. The bore 69 comprises two ball or TEFLON bearings 70 or similar to support and guide the adjusting screw 68 or its thrust pin 24 FIG. 7 and enable it to slide mechanically, without effort, when it acts with the aid of its thrust pin on the active part of the fountain blade 16 FIG. 11, thereby eliminating the need for these two components to rest on the heel of the fountain 7 FIG. 1 and so eliminating their difficulty in sliding due to being continually jammed between the fountain heel 7 and the fountain blade 2. Using known means or others, automation of the adjustment of the fountain is achieved with very good results by using the mechanical precision and flexibility of operation of the independent cojoined strips of the composite fountain blades, the independent adjusting mechanisms operating by means of eccentrics or cams and threaded sleeves with reduction screws replacing the original screws of the printing press and removable fountain blocks with automatic leak-proof adjustment, together with the whole set of advantages accruing from the invention.

The great advantage of the contributions of the invention, in addition to the correction of the inadequacies of traditional systems, lies in the fact that all the resources comprised by the invention, whatever the length of the fountains to be converted, can be installed in a short time, even by the printer himself, without spoiling the press by any machining operation.

In this way the printer, without being under any constraint, can evaluate the effectiveness of these modifications in the knowledge that in a very short time, should he so wish, his press can once again function as it originally did. This ease of putting the equipment into service represents a crucial factor for the printer in deciding to try out these considerable improvements at no risk. This ease of installation also considerably reduces the cost of these improvements by eliminating the high costs of travel and working time of a technician.

What is claimed is:

1. A fountain for a printing press, the fountain comprising:

a blade support for supporting a fountain blade which in an operative position is pressed against a fountain roller which receives ink that is dispersed to form a film between the fountain blade and the fountain roller; and wherein the fountain blade includes a plurality of independent strips coupled to the blade support such that each strip operates independently from the other strips and an active part of each strip is permitted a degree of displacement relative to the other strips to ensure proper alignment between the active parts of all of the independent strips, wherein each of the independent strips has a dovetail portion formed at a proximal end thereof.

2. The fountain of claim 1, wherein the dovetail position is mechanically fastened to a complementary feature formed in the blade support to establish a mechanical fit therebetween.

3. The fountain of claim 2, further including an adhesive area for adhesively bonding the independent strips to the blade support, the inclusion of the dovetail portion enabling reduction of the adhesive area and the length of each independent strip.

4. The fountain of claim 1, further including at least one transverse slot extending across upper surfaces of adjacent independent strips.

5. The fountain of claim 4, wherein the at least one transverse slot is filled with an elastomer to immobilize the independent strip in a rest position while permitting the independent strip, by its slight deformation, to bend slightly, so as to accompany but not impede movement of an upper part of the independent strip, while at the same time preventing it from deviating from its axis.

6. A fountain for a printing press, the fountain comprising:

a blade support for supporting a fountain blade which in an operative position is pressed against a fountain roller which receives ink that is dispersed to form a film between the fountain blade and the fountain roller, wherein the fountain blade includes a plurality of independent strips coupled to the blade support such that each strip operates independently from the other strips and an active part of each strip is permitted a degree of displacement relative to the other strips to ensure proper alignment between the active parts of all of the independent strips; and independent adjusting mechanisms coupled to the blade support, wherein each adjusting mechanism provides at least one independent adjustment of a complete displacement of an active part of the independent strip, wherein each independent adjusting mechanism includes:

a support including a threaded section;

a slide formed in the support;

a spindle slidably received within the slide;

a first eccentric disc and a second disc being one of an eccentric disc and a non-eccentric disc attached to the spindle to provide the at least one independent adjustment.

7. The fountain of claim 6, wherein each independent adjusting mechanism includes a thrust pin guided along its axis by the support to enable the thrust pin to displace the independent strip along a transverse axis thereof.

8. A fountain for a printing press, the fountain comprising:

a blade support for supporting a fountain blade which in an operative position is pressed against a fountain roller which receives ink that is dispersed to form a film between the fountain blade and the fountain roller, wherein the fountain blade includes a plurality of cuts that define adjacent strips with each strip being attached to a base section of the fountain blade at selected narrow points of attachment, wherein provision of the plurality of cuts in the fountain blade reduces extraneous stresses being applied by the base section of the blade, the plurality of cuts being arranged so that each strip operates independently from the other strips and an active part of each strip is permitted a degree of displacement relative to the other strips to ensure proper alignment between the active parts of all of the strips; and independent adjusting mechanisms coupled to the blade support, wherein each adjusting mechanism provides at least one independent adjustment of a complete displacement of an active part of the strip, wherein each independent adjusting mechanism includes:

a support including a threaded section;

a slide formed in the support;

a spindle slidably received within the slide; and a first eccentric disc and a second disc being one of an eccentric disc and a non-eccentric disc attached to the spindle to provide the at least one independent adjustment.

9. The fountain of claim 8, wherein the fountain blade includes a plurality of slots formed therein that extend from an inner section of the fountain blade to a point proximate to but not at a distal edge of the active part of the fountain blade.

10. The fountain of claim 9, wherein an underside of the fountain blade in a region from where the slots end to the distal edge has a reduced thickness to ensure that the strips are subjected to only stresses in an axis of displacement.

11. The fountain of claim 10, wherein the region of reduced thickness has a thickness of about one tenth of a millimeter.

12. The fountain of claim 9, wherein the slots are formed in different widths.

13. The fountain of claim 9, wherein the slots are filled with a hard substance in order to permit relative movement of the independent strips while maintaining a joining therebetween.

14. The fountain of claim 9, wherein the length from the proximate point to the distal edge is about 5 millimeters.

15. The fountain of claim 8, wherein each independent adjusting mechanism includes a thrust pin guided along its axis by the support to enable the thrust pin to displace the strip along a transverse axis thereof.

* * * * *